US008922460B2

(12) United States Patent
Tsuchi

(10) Patent No.: US 8,922,460 B2
(45) Date of Patent: Dec. 30, 2014

(54) LEVEL SHIFT CIRCUIT, DATA DRIVER, AND DISPLAY DEVICE

(75) Inventor: Hiroshi Tsuchi, Kanagawa (JP)

(73) Assignee: Renesas Electronics Corporation, Kawasaki, Kanagawa (JP)

( * ) Notice: Subject to any disclaimer, the term of this patent is extended or adjusted under 35 U.S.C. 154(b) by 952 days.

(21) Appl. No.: 13/064,352

(22) Filed: Mar. 21, 2011

(65) Prior Publication Data

US 2011/0234570 A1 Sep. 29, 2011

(30) Foreign Application Priority Data

Mar. 24, 2010 (JP) ..... 2010-068905

(51) Int. Cl.
*G09G 3/36* (2006.01)
*G09G 3/32* (2006.01)

(52) U.S. Cl.
CPC ..... *G09G 3/3688* (2013.01); *G09G 2310/027* (2013.01); *G09G 2310/08* (2013.01); *G09G 3/3275* (2013.01); *G09G 2310/0289* (2013.01)
USPC ..... 345/50; 345/87; 327/333

(58) Field of Classification Search
USPC ..... 345/50, 87; 327/333
See application file for complete search history.

(56) References Cited

U.S. PATENT DOCUMENTS

| | | | | |
|---|---|---|---|---|
| 5,606,270 | A * | 2/1997 | D'Souza et al. | 326/98 |
| 7,006,068 | B2 | 2/2006 | Haga | |
| 2003/0076149 | A1 * | 4/2003 | Haga | 327/333 |

FOREIGN PATENT DOCUMENTS

| | | | |
|---|---|---|---|
| JP | S 62-56018 | A | 3/1987 |
| JP | 2-188024 | A | 7/1990 |
| JP | H 9-223948 | A | 8/1997 |
| JP | 2003-115758 | A | 4/2003 |

OTHER PUBLICATIONS

Ground for Rejection dated Sep. 10, 2013, with partial English translation.

* cited by examiner

*Primary Examiner* — Sumati Lefkowitz
*Assistant Examiner* — Jose Soto Lopez
(74) *Attorney, Agent, or Firm* — McGinn IP Law Group, PLLC

(57) ABSTRACT

Disclosed is a level shift circuit that includes a first transistor of a first conductivity type connected between a first power supply line and a first node, and second and third transistors of a second conductivity type connected in series between a second power supply line and the first node. A first control signal is supplied in common to a gate of the first transistor and a gate of one of the second and third transistors. A gate of the other of the second and third transistors is connected to an input terminal to which an input signal with an amplitude lower than a power supply amplitude of the first and second power supplies is supplied. The level shift circuit includes a clocked inverter connected between the first node and a first output terminal and controlled to be turned on or off by a second control signal, an inverter with an input thereof connected to the first output terminal, and a switch connected between the first node and an output of the inverter and controlled to be turned on or off by a third control signal. The clocked inverter and the inverter are both arranged between the first and second power supply lines.

13 Claims, 13 Drawing Sheets

REFERENCE CASE

REFERENCE CASE

LEVEL SHIFT CIRCUIT, DATA DRIVER, AND DISPLAY DEVICE

REFERENCE TO RELATED APPLICATION

This application is based upon and claims the benefit of the priority of Japanese patent application No. 2010-068905 filed on Mar. 24, 2010, the disclosure of which is incorporated herein in their entirety by reference thereto.

TECHNICAL FIELD

The present invention relates to a level shift circuit, and a data driver using the level shift circuit and a display device using the level shift circuit

BACKGROUND

A liquid crystal display device (LCD), featured by thin thickness, light weight and low power consumption has recently come into widespread use, and is being predominantly employed as a display unit of mobile equipments, such as a portable telephone set (mobile phones or cellular phones), or a PDA (Personal Digital Assistants) or a notebook personal computer. In these days, with the progress in the technique for increasing a viewing area and for coping with moving images, the LCD display is now usable not only for mobile equipment but also for a stationary large screen display device and for a large screen size liquid crystal television set. A liquid crystal display device of an active matrix driving system is in use. As a thin type display device, a display device of the active matrix driving system employing an organic light emitting diode (OLED) also has been developed.

A typical configuration of an active matrix driving system thin type display device (one of a liquid crystal display device and an organic light-emitting diode display device) will be outlined with reference to FIG. 8. FIG. 8 is a diagram showing a configuration of essential portions of the thin type display device. Referring to FIG. 8, the active matrix driving system thin type display device includes a power supply circuit 940, a display controller 950, a display panel 960, a gate driver 970, and a data driver 980.

Unit pixels each including a pixel switch 964 and a display element 963 are arranged on the display panel 960 in the form of a matrix (for instance, 1280×3 pixel columns×1024 pixel rows in the case of a color SXGA (Super Extended Graphics Array) panel). Scan lines 961 and data lines 962 is formed. A plurality of scan lines 961, each of which sends a scan signal output from the gate driver 970 to a unit pixel, and a plurality of data lines 962, each of which sends a gray scale voltage signal output from the data driver 980 to the unit pixel are arrayed in a lattice-shaped configuration. The gate driver 970 and the data driver 980 are controlled by the display controller 950, and a clock CLK, control signals, and the like necessary for each of the gate driver 970 and the data driver 980 are supplied from the display controller 950. Video data is supplied to the data driver 980 in the form of a digital signal. The power supply circuit 940 supplies power supplies necessary for the gate driver 970 and the data driver 980, respectively. The display panel 960 is formed of a semiconductor substrate. The semiconductor substrate with thin-film transistors (Thin Film Transistors: TFTs) which are formed on an insulating substrate such as a glass substrate or a plastic substrate as pixel switches has been widely used in large-screen display devices.

Turning on (conduction)/off (non-conduction) of each pixel switch 964 in the display device is controlled by the scan signal. When the pixel switch 964 is turned on (brought into a conductive state), a gray scale voltage signal corresponding to video data is applied to the display element 963. Brightness of the display element 963 is varied according to the gray scale signal, thereby displaying an image. In the liquid crystal display device, the display element 963 includes a liquid crystal. In the organic light-emitting diode display device, the display element 963 includes an organic light-emitting diode.

Data for one screen is re-written every frame period (usually approximately 0.017 seconds, for 60 Hz driving). Data is successively selected (pixel switch 964 is turned on) every pixel row (every line) by each scan line 961. A gray scale signal is supplied to the display element 963 through the pixel switch 964 from each data line 962 during a selection period. There are cases where a plurality of pixels is simultaneously selected by scan lines or the driving is performed by a frame frequency higher than 60 Hz.

FIG. 9 is a diagram showing a typical configuration example of essential portions of the data driver 980 in FIG. 8. Referring to FIG. 9, the data driver 980 includes a shift register 801, a data register/latch 802, a set of level shift circuits 803, a reference signal generation circuit 804, a set of decoder circuits 805, and a set of output buffers 806.

The shift register 801 determines a data latch timing, based on a start pulse and the clock signal CLK. The data register/latch 802 develops input video digital data into a bit signal for each output and latches bit signals for every predetermined number of outputs based on the timing determined by the shift register 801, and outputs the bit signals to the set of level shift circuits 803 in response to an STB (strobe) signal. Each of the set of level shift circuits 803 level shifts the bit signal for each output supplied from the data register/latch 802 from a low-amplitude signal to a high-amplitude signal, and outputs complementary high-amplitude bit signals (DH, DBH) to a corresponding one of the decoder circuits 805. Each of the decoder circuits 805 selects, for each output, a reference signal corresponding to the input digital data (bit signal) from among reference signals generated by the reference signal generation circuit 804. Each of the output buffers 806 receives the reference signal selected by the corresponding one of the decoder circuits 805, and amplifies and outputs the grayscale signal corresponding to the reference signal. Output terminals of the output buffers 806 are connected to the data lines of the display device. Each of the shift register 801 and the data register/latch 802 is a logic circuit which is generally formed by low-amplitude voltage signals VE3 and VE4 (e.g., VE3=3.3V, VE4=0V) to which a corresponding supply voltage is supplied.

The set of level shift circuits 803, the set of decoder circuits 805, and the set of output buffers 806 handle high-amplitude voltage signals VE1 and VE2 (e.g., VE1=18V, VE2=0V) necessary for driving a display element, and corresponding supply voltages are supplied to the set of level shift circuits 803, the set of decoder circuits 805, and the set of output buffers 806. Level shifting from a low-amplitude voltage signal to a high-amplitude voltage signal is performed by each of the set of level shift circuits 803. The set of level shift circuits 803 include a plurality of level shift circuits corresponding to the number of bits of video digital data, each of which receives and converts the bit signal of the low-amplitude voltage signal to the bit signal of the high-amplitude voltage signal for each output.

In recent years, a demand for higher image quality has increased in mobile devices including thin type display devices for high-end applications, notebook PCs, monitors, and TVs. Specifically, there has arisen a demand for an increase in the number of colors (increase in the number of bits) (of approximately 16800 thousand colors or more) of 8-bit video digital data for each of RGB, an increase in a frame frequency (driving frequency for rewriting one screen) to 120 Hz or more for improvement of a moving image characteristic and for supporting three-dimensional display. For this reason, the data driver of a display device must process multiple-bit video digital data at high speed, and a reduction of a power supply voltage (to 0 to 2V or less, for example) of a logic circuit has been demanded.

The set of level shift circuits 803 are greatly affected by the reduced supply voltage of the logic circuit. The set of level shift circuits 803 include high-breakdown-voltage transistors each having a high breakdown voltage for a high-amplitude voltage signal. The threshold voltage of the high-breakdown-voltage transistor is comparatively high. For this reason, in case the power supply voltage of a logic circuit is lowered, and a High potential of a low-amplitude digital signal supplied to the set of level shift circuits 803 is close to the threshold voltage of the high-breakdown-voltage transistors in the set of level shift circuits 803, a drain current of each transistor which receives the low-amplitude voltage signal at a gate thereof is reduced. The drain current is proportional to a square of [(gate voltage)−(threshold voltage)]. High-speed level shifting may become thereby difficult or a level shift operation itself may be difficult to perform.

The following technique is disclosed as a technique for level shifting a low-amplitude digital signal to a high-amplitude voltage signal.

FIG. 10 is a circuit showing a configuration corresponding to the circuit disclosed in FIG. 2 of Patent Document 1 (JP Patent Kokai Publication JP-A-2-188024). Reference numerals for elements and the like in FIG. 10 are made to be different from those in FIG. 2 of Patent Document 1, for convenience of description. Referring to FIG. 10, N-channel MOS transistors M81 and M82 and P-channel MOS transistors M83 and M84 form a typical cross-coupled level shift circuit. The circuit in FIG. 10 further includes a first current supply circuit 91 and a second current supply circuit 92.

The following describes an operation of the level shift circuit (M81, M82, M83, M84). Referring to FIG. 10, voltages of a low-amplitude signal IN and a complementary signal INB of the low-amplitude signal IN assume VDD1 and VSS (in which VSS is a low-potential side supply voltage), voltages of a high-amplitude output signal OUT for the low-amplitude signal IN and a complementary signal OUTB of the high-amplitude output signal OUT assume VDD2 (in which VDD2>VDD1) and VSS.

The level shift circuit (M81, M82, M83, M84) includes:

the N-channel MOS transistors M81 and M82 which have sources connected in common to a power supply VSS, have drains connected to output terminals N74 and N73, respectively, and have gates connected to input terminals N71 and N72, respectively; and the P-channel MOS transistors M83 and M84 which have sources connected in common to a power supply VDD2, have drains connected to the output terminals N74 and N73, respectively, and have gates cross-coupled to the output terminals N73 and N74, respectively.

The digital input signals IN and INB each having a low-amplitude (VDD1-VSS) are supplied to the input terminals N71 and N72, respectively. When the input signal IN is at a High level (=VDD1), the transistor M81 is turned on, and the output terminal N74 connected to a drain node of the transistor M81 assumes the voltage VSS. The transistor M82 is turned off, and the transistor M84 is turned on. The output terminal N73 connected to a drain node of the transistor M84 assumes a power supply voltage VDD2. On the other hand, when the input signal INB is at the High level (=VDD1), the transistor M82 is turned on, and the output terminal (OUT) N73 connected to a drain node of the transistor M82 assumes the voltage VSS. Then, the transistor M81 is turned off, and the transistor M83 is turned on. The output terminal (OUTB) N74 connected to a drain node of the transistor M83 assumes the power supply voltage VDD2.

Referring to FIG. 10, in case the amplitudes of the input signals IN and INB are reduced, at a time when potentials of the input signals IN and INB are changed, a discharging operation of the N-channel MOS transistors M81 and M82 and a charging operation of the P-channel MOS transistors M83 and M84 occur transiently at the same time. Thus, a malfunction or a short-through current between power supplies tends to occur.

Specifically, it is assumed that the input signals IN and INB are respectively set to be at a Low level (VSS) and a High level (VDD1), and that the output signals OUT and OUTB are respectively set to be at a Low level (VSS) and a High level (VDD2), as an initial state, for example. The transistors M81 and M82 are off (electrically nonconductive) and on (electrically conductive), respectively, and the transistors M83 and M84 are on and off, respectively.

When the input signals IN and INB are respectively changed to the High level and the Low level from the initial state, the transistors M81 and M82 are turned on and off, respectively, immediately after this change. Further, immediately after the change, the output signals OUT and OUTB are Low and High, respectively. The transistors M83 and M84 are on and off, respectively.

For this reason, the transistor M81 must lower a potential of the output signal OUTB to Low (VSS) with discharging capability exceeding charging capability of the transistor M83 in order to normally perform a level shift operation.

When the potential of the output signal OUTB is lowered, the transistor M84 is turned on, and the output signal OUT is raised to the power supply voltage VDD2. Then, the transistor M83 is turned off, thereby completing level shifting.

When the input signals IN and INB are respectively changed to the Low level and the High level, operations of the transistors M81 and M83 and the transistors M82 and M84 are reversed from those described above.

When the amplitude of the input signal IN is reduced, gate-to-source voltages of the N-channel MOS transistors M81 and M82 are reduced. Discharging capabilities of the N-channel MOS transistors are reduced (namely, drain currents of the transistors M81 and M82 are reduced). Then, malfunction tends to occur.

When the amplitude of the input signal IN is reduced, and when changes of the output signals OUT and OUTB are slow, even if a normal level shift operation is performed, the transistors M81 and M83 are both transiently turned on, or the transistors M82 and M84 are both transiently both turned on. Accordingly, the through current from the power supply VDD2 to the power supply VSS flows. This results in the increase in power consumption.

The first current supply circuit 91 and the second current supply circuit 92 are provided for the level shift circuit (M81, M82, M83, M84) to normally perform the level shift operation and also to achieve a high speed level shift operation, even if the amplitude of the input signal IN/INB is low in the configuration in FIG. 10.

The first current supply circuit 91 operates when the input signal IN is changed from the Low level (VSS) to the High level (VDD1). The second current supply circuit 92 operates when the input signal INB is changed from the Low level (VSS) to the High level (VDD1).

The current supply circuit 91 includes:

a P-channel MOS transistor M85 that has a source thereof connected to the power supply VDD2 and has a drain and a gate connected together;

a P-channel MOS transistor 86 that has a source connected to the power supply VDD2, has a gate connected to the gate of the P-channel MOS transistor M85, and has a drain connected to the output terminal N73;

an N-channel MOS transistor M89 that has a drain connected to the drain of the P-channel MOS transistor M85 and has a gate connected to the input terminal N71; and an N-channel MOS transistor M90 that has a drain connected to a source of the N-channel MOS transistor M89, has a gate connected to the output terminal N74, and has a source connected to the power supply VSS.

The second current supply circuit 92 includes:

a P-channel MOS transistor M88 that has a source connected to the power supply VDD2 and has a drain and a gate connected together;

a P-channel MOS transistor M87 that has a source connected to the power supply VDD2, has a gate connected to the gate of the P-channel MOS transistor M88, and has a drain connected to the output terminal N74;

an N-channel MOS transistor M91 that has a drain connected to the drain of the P-channel MOS transistor M88 and has a gate connected to the input terminal N72; and an N-channel MOS transistor M92 that has a drain connected to a source of the N-channel MOS transistor M91, has a gate connected to the output terminal N73, and has a source connected to the power supply VSS.

It is assumed that the input signals IN and INB are respectively set to be at a Low level (VSS) and at a High level (VDD1), and that the output signals OUT and OUTB are respectively set to be at a Low level (VSS) and a High level (VDD2), as the initial state. The transistors M81 and M82 are off and on, respectively, and the transistors M83 and M84 are on and off, respectively. A description will be directed to a case where the input signal IN and INB are respectively changed to the High level (VDD1) and the Low level (VSS) from this initial state.

Immediately after the input signal IN and the input signal INB have been respectively changed to the High level (VDD1) and the Low level (VSS), the transistors M81 and M82 are respectively turned on and off. Immediately after the input signal IN and the input signal INB have been respectively changed to the High level (VDD1) and the Low level (VSS), the output signal OUT is Low and the output signal OUTB is High. The transistors M83 and M84 are respectively on and off.

In the first current supply circuit 91, the input signal IN at the High level (VDD1) is supplied to the gate of the transistor M89, and the output signal OUTB at the High level (VDD2) is supplied to the gate of the transistor M90, so that the transistors M89 and M90 are both turned on. Then, a drain current responsive to a voltage between a gate voltage (VDD1) and a source voltage (VSS) of the transistor M89 is supplied to the transistor M85 of a current mirror (M85, M86). An output current (mirror current) obtained by folding back an input current to the current mirror is output from the drain of the transistor M86 to charge the output terminal N73. A drain current (mirror current) of the transistor M86 is set to a current obtained by amplifying the input current to the current mirror. The drain current of the transistor M86 raises a potential of the output signal OUT at the output terminal 73 and turns off the transistor M83. An amplification factor (mirror ratio) of the output current to the input current of the current mirror is determined by a gate width ratio of the transistor M86 to the transistor M85, (which is larger than one), when gate lengths of the transistors M85 and M86 are set to be the same.

On the other hand, the transistor M81 is turned on to reduce the potential of the output signal OUTB at the output terminal N74 to which the drain of the transistor M81 is connected. The transistor M84 is thereby turned on, and level shifting is completed.

When the potential of the output signal OUTB is lowered, the transistor M90 at the first current supply circuit 91 is turned off. The first current supply circuit 91 is thereby stopped. As described above, the first current supply circuit 91 quickly raises the potential of the output terminal N73 immediately after the change from the initial state, thereby turning off the transistor M83. For this reason, the transistor M81 can quickly lower the potential of the output signal OUTB at the output terminal N74. Accordingly, the level shift operation can be normally performed at high speed.

The second current supply circuit 92 operates when the input signal INB is changed from the Low level to the High level. It is assumed that the input signals IN and INB are respectively set to be at the High level (VDD1) and the Low level (VSS), and that the output signals OUT and OUTB are respectively set to be at the High level (VDD2) and the Low level (VSS), as the initial state.

The transistors M82 and M81 are respectively off and on, and the transistors M84 and M83 are respectively on and off. A description will be directed to a case where the input signals IN and INB are respectively changed to the Low level (VSS), and the High level (VDD1).

Immediately after the input signals IN and INB have been respectively changed to the Low level (VSS) and the High level (VDD1), the transistors M81 and M82 are respectively turned off and on. Immediately after the input signals IN and INB have been respectively changed to the Low level (VSS) and the High level (VDD1), the output signals OUT and OUTB are respectively High and Low. The transistors M83 and M84 are respectively off and on.

In the second current supply circuit 92, the input signal INB at the High level (VDD1) is supplied to the gate of the transistor M91, and the output signal OUT at the High level (VDD2) is supplied to the gate of the transistor M92, so that the transistors M91 and M92 are both turned on. Then, a drain current responsive to a voltage between a gate voltage (VDD1) and a source voltage (VSS) of the transistor M91 is supplied to the transistor M88 of a current mirror (M88, M87). An output current (mirror current) obtained by folding back an input current to the current mirror is output from the drain of the transistor M87 to charge the output terminal N74. A drain current (mirror current) of the transistor M87 is set to a current obtained by amplifying the input current to the current mirror. The drain current of the transistor M87 raises the potential of the output signal OUTB at the output terminal 74 and turns off the transistor M84. An amplification factor (mirror ratio) of the output current to the input current of the current mirror is determined by a gate width ratio of the transistor M87 to the transistor M88, (which is larger than one), when gate lengths of the transistors M88 and M87 are set to be the same.

On the other hand, the transistor M82 is turned on, and the potential of the output signal OUTB at the output terminal N74 to which the drain of the transistor M82 is connected is lowered to the power supply voltage VSS. As a result, the transistor M84 is turned on, and the output signal OUT is raised to the power supply voltage VDD2. Level shifting is thereby completed.

When the potential of the output signal OUT is lowered, the transistor M92 of the second current supply circuit 92 is turned off, so that the second current supply circuit 92 is stopped. As described above, in the second current supply circuit 92, the potential of the output terminal N74 is quickly raised to turn off the transistor M84. The transistor M82 can therefore quickly reduce the potential of the output signal OUT of the output terminal N73. Accordingly, the level shift operation can be normally performed at high speed.

As described above, the level shift circuit in FIG. 10 can perform level shifting to a high-amplitude output signal even when the amplitude of an input signal is low.

Further, the output signals OUT and OUTB are changed quickly in the circuit in FIG. 10. Accordingly, a period of time during which the transistors M81 and M83 are transiently and simultaneously turned on or a period of time during which the transistors M82 and M84 are transiently and simultaneously turned on is short. The through current can be thereby suppressed.

Patent Document 2 (JP Patent Kokai Publication No. JP-P-2003-115758A) discloses a technique performing level shifting of a video digital signal with a low amplitude (0V to 3V) to a voltage signal with a high amplitude (0V to 10V) for driving a display element in a data line driving circuit for liquid crystal driving, formed of poly silicon thin film transistors. FIG. 11 is a diagram cited from FIG. 1 in Patent Document 2. Referring to FIG. 11, a level shift circuit includes an N-channel MOS transistor MN1 connected between a terminal N62 and an input terminal N61 to which a low-amplitude input signal IN is supplied, an N-channel MOS transistor MN2 that has a source connected to the GND and has a gate connected to the terminal N62, an N-channel MOS transistor MN3 that has a source connected to a drain of the transistor MN2 and has a drain connected to a terminal N63, a P-channel MOS transistor MP1 that has a source connected to a 10V power supply and has a drain connected to the terminal N63, and an inverter (MN4, MP2) connected between the terminal N63 and an output terminal N64. A signal XSMP is supplied to a gate of the N-channel MOS transistor MN1. The inverter operates between the 10V power supply and the GND. Capacitances C1 and C2 capable of temporarily holding terminal voltages are connected to the terminals N62 and N63, respectively. A signal SMP is supplied in common to gates of the transistors MN3 and MP1. Each of the signals SMP and XSMP is a sampling control signal with a high amplitude (0V to 10V). The signal XSMP is a complementary signal of the signal SMP. FIG. 11 shows a sampling level converting unit of the data line driving circuit. Low-amplitude video serial data is supplied to the input terminal N61. When the sampling control signal SMP is Low (0V) and the signal XSMP is High (10V), the transistor MN1 is turned on to sample the serial data supplied to the input terminal N61. A low-amplitude data signal at a High (3V) level or a Low (0V) level is then held in the capacitance C1 connected to the terminal N62. In this case, the transistors MP1 and MN3 are respectively turned on and off. The terminal N63 is precharged to High (10V), and a signal OUT of the output terminal N64 is set to Low (0V) by the inverter (MN4, MP2).

Next, when the sampling control signal SMP is changed to High (10V) and the signal XSMP is changed to Low (0V), the transistor MN1 is turned off, and the data signal held in the capacitance C1 connected to the terminal N62 is continuously held. The transistors MP1 and MN3 are respectively turned off and on. Since the transistor MN3 is turned on, a voltage at the terminal N63 is changed according to the data signal held in the capacitance C1 connected to the terminal N62. That is, when the data signal for the terminal N62 is High (3V), the transistor MN2 is turned on. The voltage at the terminal N63 is then changed to Low (0V) from High (10V) to be held in the capacitance C2. When the data signal for the terminal N62 is Low (0V), the transistor MN2 is turned off, and the voltage at the terminal N63, which remains High (10V), is held in the capacitance C2. On the other hand, a voltage at the output terminal N64 is an inverter output of an output at the terminal 63. The voltage at the output terminal N64 therefore has a logical value opposite to a logical value of the terminal N63. That is, a high-amplitude data signal having a same logical value as the low-amplitude data signal at the terminal N62 is output from the output terminal N64. In the configuration in Patent Document 2, a high-voltage latch circuit (not shown) is connected to a stage subsequent to the output terminal N64 in FIG. 11, and a level-shifted voltage signal is stably held in the latch circuit for a predetermined period of time, and the latched signal is supplied to a decoder (DAC) (in FIG. 22 of JP Patent Kokai Publication JP-P-2003-115758).

Patent Document 1: JP Patent Kokai Publication No. JP-A-2-188024

Patent Document 2: JP Patent Kokai Publication No. JP-P2003-115758A

SUMMARY

The following describes analyses on the related arts.

The level shift circuits of the above described related arts have various problems when applied to each of the set of level shift circuits 803 in the data driver shown in FIG. 9.

The set of level shift circuits 803 shown in FIG. 9 have the set of level shift circuits, the number of which is the product of the number of outputs and the number of bits. Accordingly, it is important to reduce the area per level shift circuit. That is, an area-saving level shift circuit for level shifting a low-amplitude bit signal to a high-amplitude signal at high speed is demanded.

The set of level shift circuits 803 shown in FIG. 9 supply output signals to the set of decoder circuits 805. For this reason, the output terminal of each level shift circuit is connected to a bit signal line of a corresponding one of the decoder circuits. Gates of transistors (switch transistors) forming each decoder circuit are connected to the bit signal line of the decoder circuit. It is demanded that each level shift circuit of the set of level shift circuits 803 drives a load capacitance including capacitances of gates of these transistors and wiring capacitances at high speed.

The configuration shown in FIG. 10 is formed of 12 transistors per level shift circuit. The first current supply circuit 91 is in charge of charging of the output terminal N73, and the second current supply circuit 92 is in charge of charging of the output terminal N74. The drain current of the transistor M89 which receives the low-amplitude input signal IN at the gate thereof must be amplified by the current mirror (M85, M86) in order for the first current supply circuit 91 to supply an output current (drain current of the transistor M86) with high driving capability. That is, the gate width of the transistor M86 needs to be sufficiently larger than the gate width of the transistor M85. Similarly, the gate width of the transistor M87 needs to be sufficiently larger than the gate width of the transistor M88 in order for the second current supply circuit 92 to supply an output current (drain current of the transistor M87) with high driving capability. For this reason, there is a problem that the area of the level shift circuit in FIG. 10 increases.

The number of the transistors necessary for level shifting is small in the configuration in FIG. 11. The configuration in FIG. 11, however, does not have a function of stably holding a level-shifted voltage signal during one data period in which a data line is driven. That is, referring to FIG. 11, the signal voltage at the terminal N62 is held by the capacitance C1, and the signal voltage at the terminal N63 is held by the capacitance C2. Capacitance values of the capacitances C1 and C2 cannot be increased so as to perform a high-speed operation. For this reason, when holding the signal voltages by the capacitances C1 and C2 during one data period, there is a problem that, when the voltages held by the capacitances C1 and C2 change due to noise or the like, the signal voltages cannot be returned to those before the change. If a latch circuit is provided in a stage subsequent to the configuration in FIG. 11, so as to stably hold the level-shifted voltage signal during one data period, the number of the transistors is increased, so that the area of the level shift circuit is increased.

It is an object of the present invention to provide a level shift circuit in which a low-amplitude digital signal can be quickly level-shifted to a high-amplitude voltage signal and the level-converted voltage signal can be stably held during a predetermined period of time, a data driver including the level shift circuit, and a display device including the level shift circuit.

In addition to the above object, another object of the present invention is to provide an area-saving level shift circuit with a simplified configuration, a data driver including the level shift circuit, and a display device including the level shift circuit.

According to the present invention, there is provided a level shift circuit comprising:

an input terminal;

a first output terminal;

a first node;

a first power supply line supplied connected to a first power supply having a first power supply voltage;

a second power supply line connected to a second power supply having a second power supply voltage;

a first transistor of a first conductivity type connected between the first power supply line and the first node;

second and third transistors of a second conductivity type connected in series between the second power supply line and the first node, wherein the first and second transistors include control terminals supplied with a first control signal in common to be controlled to be turned on or off, complementarily, and the third transistor includes a control terminal connected to the input terminal to which an input data signal is supplied, an amplitude of the input data signal being lower than a power supply amplitude between the first power supply voltage and the second power supply voltage;

a clocked inverter which is arranged between the first power supply line and the second power supply line, an input and output of which are connected respectively to the first node and the first output terminal, and which is controlled to be turned on or off by a second control signal supplied thereto;

an inverter arranged between the first power supply line and the second power supply line, an input of which is connected to the first output terminal; and a switch which is connected between the first node and an output of the inverter, and which is controlled to be turned on or off by a third control signal. According to the present invention, a data driver including the level shift circuit and a display device including the data driver are provided.

According to the present invention, a low-amplitude digital input signal can be level-shifted to a high-amplitude voltage signal at high speed, and the level-shifted signal can be stably held. According to the present invention, the configuration of the level shift circuit can be simplified, and the area of the level shift circuit can be saved.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED MODES

Figure 1:
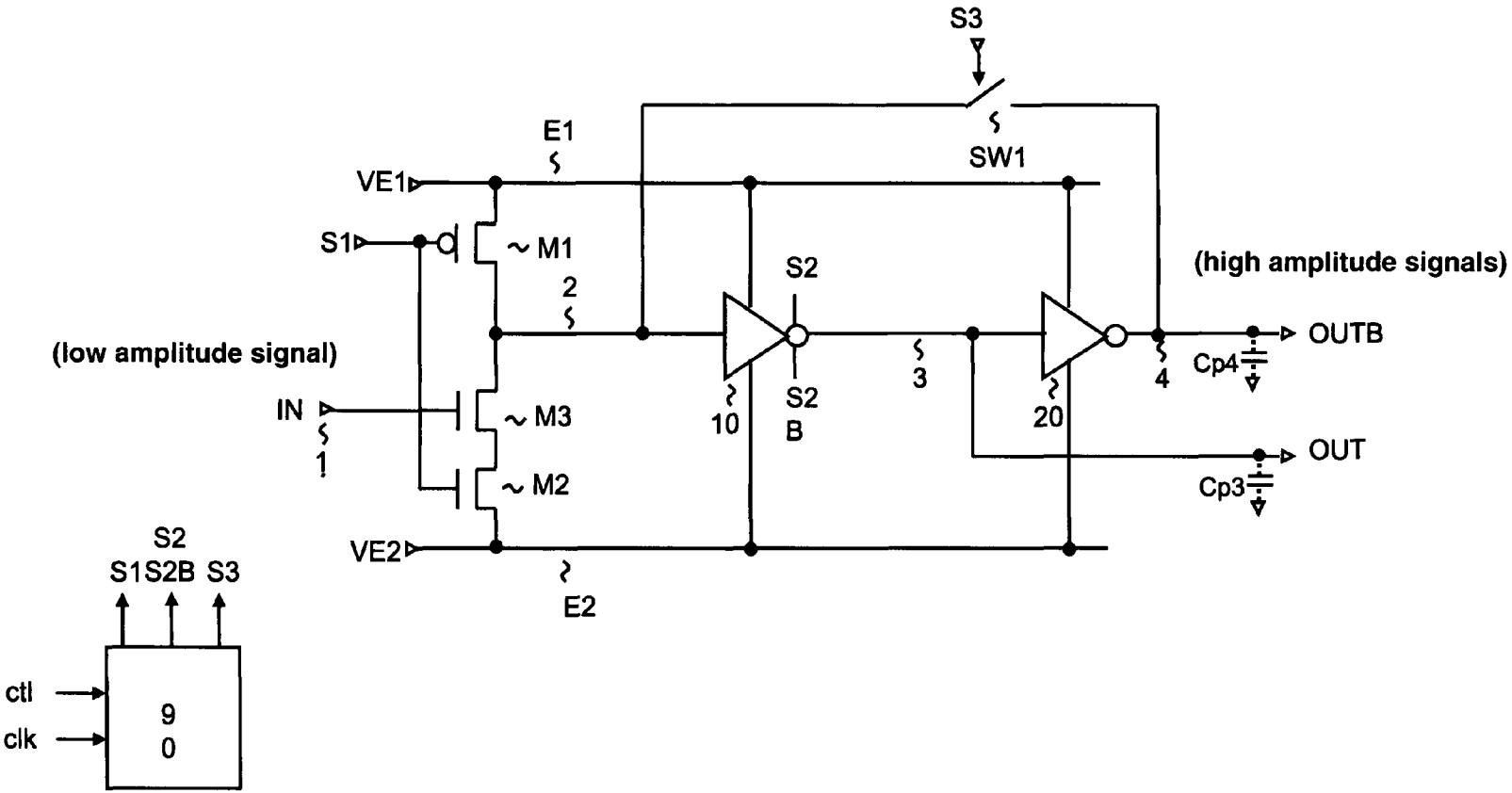
FIG. 1 is a diagram showing a configuration of a first exemplary embodiment of the present invention.

The following describes preferred modes of the present invention. A level shift circuit in one of modes of the present invention includes:

a first transistor (M1) of a first conductivity type connected between a first power supply line (E1) connected to a first power supply having a first power supply voltage (VE1), and a first node (2); and second and third transistors (M2, M3) connected in series between a second power supply line (E2) connected to a second power supply having a second power supply voltage (VE2), and the first node (2). A first control signal (S1) is supplied in common to a control terminal (gate terminal) of the first transistor (M1) and one of control terminals (gate terminals) of the second and third transistors (M2, M3) to control turning on or off of each of the first and one of the second and third transistors. The control terminals (gate terminal) of the other of the second and third transistors (M2, M3) is connected to an input terminal (1) to which an input data signal (IN) having an amplitude lower than a power supply amplitude between the first power supply voltage and the second power supply voltage is supplied. The level shift circuit further includes a clocked inverter (10) having an input and an output connected to the first node (2) and a first output terminal (3), respectively, an inverter (20) having an input connected to the first output terminal (3), and a switch (SW1) connected between the first node (2) and an output of the inverter (20). The clocked inverter (10) is arranged between first power supply line (E1) and the second power supply line (E2). The clocked inverter (10) is controlled to be turned on or off by a second control signal (S2). The inverter (20) is arranged between the first power supply line (E1) and the second power supply line (E2). The switch (SW1) is controlled to be turned on or off by a third control signal (S3). According to the precharge/latch type level shift circuit configured as described above, a low-amplitude digital input data signal (IN) is able to be level-shifted to a high-amplitude output data signal at high speed, and the level-shifted signal is able to be stably held. The following describes several exemplary embodiments.

First Exemplary Embodiment

FIG. 1 is a diagram showing a configuration of a first exemplary embodiment of the present invention. Referring to FIG. 1, a level shift circuit in this exemplary embodiment includes:

a first power supply line E1 for supplying a high-potential side power supply voltage VE1 and a second power supply line E2 for supplying a low-potential side power supply voltage VE2;

an input terminal 1 to which a low-amplitude digital input data signal IN is supplied;

a first output terminal 3 which outputs a high-amplitude output data signal OUT having a same logical value as the input data signal IN;

a second output terminal 4 which outputs a high-amplitude output data signal OUTB that is complementary with (has an opposite logical value to) the output data signal OUT;

a P-channel MOS transistor M1 that has a source connected to the first power supply line E1 and has a drain connected to a node 2;

an N-channel MOS transistor M2 that has a source connected to the power supply line E2 and has a gate connected in common to a gate of the P-channel MOS transistor wherein a control signal S1 is supplied in common to gates of the N-channel MOS transistor M2 and the P-channel MOS transistor M1;

an N-channel MOS transistor M3 that has a drain connected to the node 2, has a source connected to a drain of the N-channel MOS transistor M2, and has a gate connected to the input terminal 1;

a clocked inverter 10 that has an input connected to the node 2 and has an output connected to the first output terminal 3, and that is controlled to be operated or stopped by a control signal S2 and a complementary signal S2B of the control signal S2;

an inverter 20 that has an input connected to the first output terminal 3 and has an output connected to the second output terminal 4; and a switch SW1 that is connected between the node 2 and the second output terminal 4 and that is controlled to be turned on or off by a control signal S3.

The first and second power supply lines E1 and E2 are supplied with power supply voltages VE1 and VE2, respectively. The clocked inverter 10 and the inverter 20 are connected between the power supply lines E1 and E2.

A control signal generation circuit 90 generates the control signals S1, S2, S2B, and S3 (each having amplitudes of the power supply voltages VE1 and VE2). The control signal generation circuit 90 generates the control signals S1, S2, S2B, and S3, on the basis of a low-amplitude clock clk and a low-amplitude timing signal ctl, level-shifts and outputs the control signals S1, S2, S2B, and S3 to high-amplitude control signals.

Capacitances Cp3 and Cp4 respectively connected to the output terminals 3 and 4 indicate load capacitances of circuits respectively connected to the output terminals 3 and 4.

Figure 2:
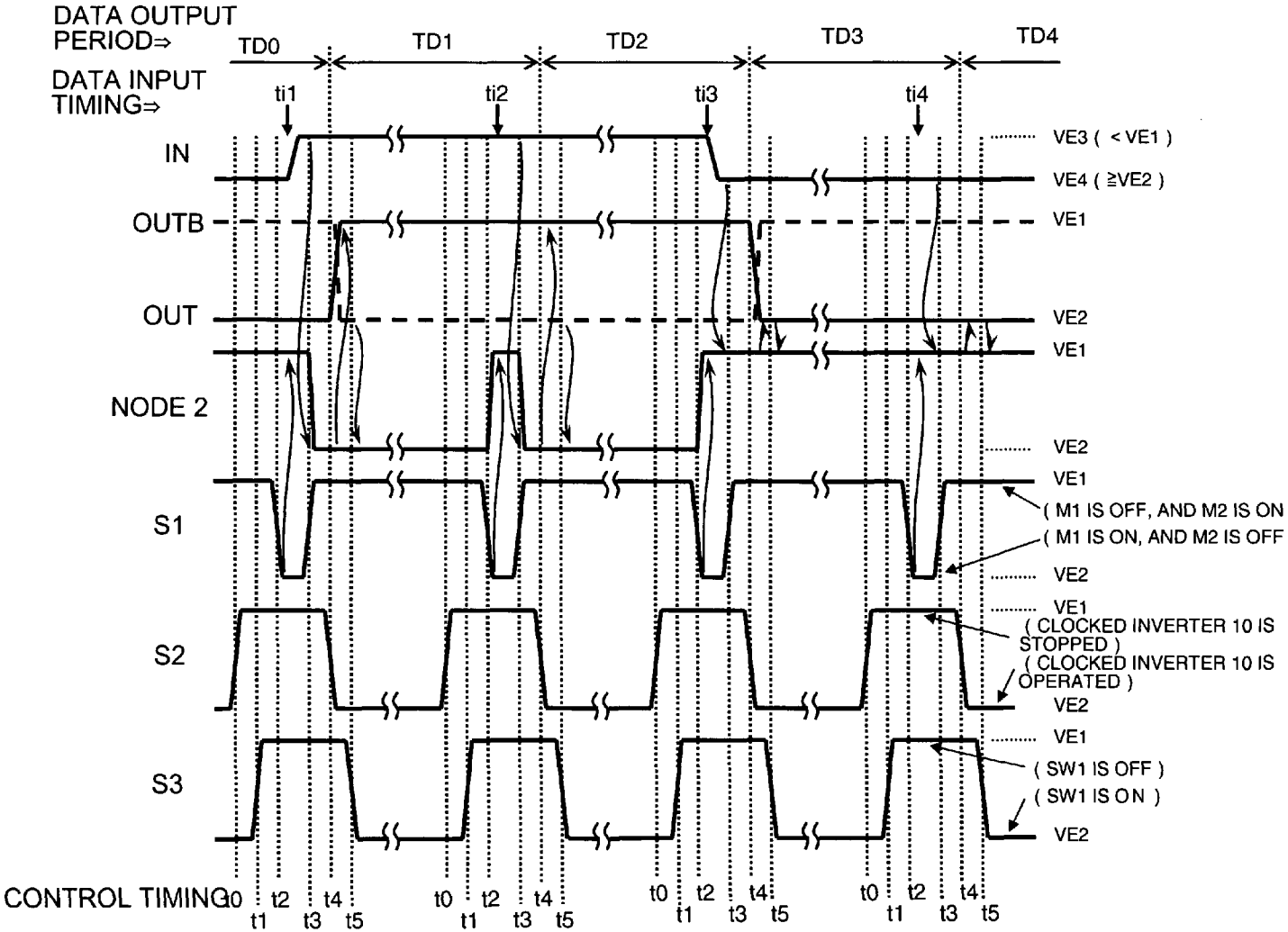
FIG. 2 is a diagram explaining an operation of the first exemplary embodiment of the present invention.

FIG. 2 is a timing chart showing an example of an operation of the level shift circuit in FIG. 1. FIG. 2 shows timing waveforms of the input data signal IN, the output data signals OUT and OUTB, a voltage at the node 2, and the control signals S1, S2, and S3. FIG. 2 shows each signal waveform during five data output periods from a data output period TD0 to a data output period TD4 for outputting the output data signals OUT and OUTB. Each of the control signals S1, S2, and S3 is set to a signal of which a logical value regularly changes before or after switching of each data output period, and change timings of the control signals S1, S2, and S3 are indicated by t0 to t5. The input data signal IN is set to a digital signal that assumes a High-level voltage VE3 (VE3<VE1) and a Low-level voltage VE4 (VE4≥VE2). The complementary signal S2B of the control signal S2 is omitted in FIG. 2. The following describes the operation of the level shift circuit with reference to FIGS. 1 and 2.

First, in the data output period TD0, the input data signal IN is set to be Low (VE4), the output data signals OUT and OUTB are respectively set to be Low (VE2) and High (VE1).

The voltage at the node 2 is set to be High (VE1), the control signal S1 is set to be High (VE1), and both of the control signals S2 and S3 are set to be Low (VE2).

At the time t0, before switching from the data output period TD0 to the data output period TD1, the control signal S2 goes High (VE1) from Low, and the clocked inverter 10 is turned off to electrically disconnect the node 2 from the first output terminal 3.

At the time t1, after the time t0, the control signal S3 goes High (VE1) from Low. The switch SW1 is thereby turned off to electrically disconnect the node 2 from the output terminal 4.

In a time period from the time t2 to the time t3 after the time t1, the control signal S1 is set to Low (VE2), the pMOS transistor M1 is turned on, the nMOS transistor is turned off, and the node 2 is precharged to be High (VE1).

At a predetermined timing (at a time ti1) between the time t2 and the time t3, the input data signal IN at a High level (VE3) corresponding to the data output period TD1 is supplied to the input terminal 1. At this point of time, the signal at the High level (VE3) is applied to the gate of the transistor M3, but the transistor M2 is turned off. Thus, the transistor M3 is not turned on.

When the control signal S1 is changed from Low to High (VE1) at the time t3, the transistor M1 is turned off, the transistor M2 is turned on, and the transistor M3 is also turned on. Then, the node 2 is driven from High (VE1) to Low (VE2).

At the time t4 after the time t3, the control signal S2 is changed from High to Low (VE2), and the clocked inverter 10 is in operation, again. With this arrangement, a logical value at the High level (VE1) opposite to a logical value of the node 2 is output to the output terminal 3, and a logical value at the Low (VE2) level which is the same as the logical value of the node 2 is output to the output terminal 4. That is, the time 4 is a (data output period switch) timing, at which data values of the output data signal OUT of the output terminal 3 and the output data signal OUTB of the output terminal 4 are switched.

At the time t5 after the time t4, the control signal S3 is set to Low (VE2), so that the switch SW1 is turned on. With this arrangement, the node 2 and the output terminal 4 (which are both Low (VE2)) are electrically connected, and an output of the inverter 20 (from the output terminal 4) is feedback connected to an input of the clocked inverter 10 (at the node 2). Thus, the output data signal OUT of the output terminal 3 and the output data signal OUTB of the output terminal 4 are stably held to be High (VE1) and Low (VE2).

The following describes the operations at a time of switching from the data output period TD1 to the data output period TD2. Control by the control signals S1, S2, and S3 is the same at a time of switching of each data output period. That is, operations where the clocked inverter 10 is stopped at a time t0, the switch SW1 is turned off at a time t1, and the transistors M1 and M2 are turned on and off, respectively and the node 2 is precharged to High (VE1) in a time period from a time t2 to a time t3 are common for each data output period. At the time t2, the level of the node 2 changes from Low (VE2) to High (VE1). At this point, the clocked inverter 10 is stopped. Thus, the voltage change of the node 2 does not affect the output data signal OUT of the output terminal 3 and the output data signal OUTB of the output terminal 4.

At a predetermined timing (time ti2) between the time t2 and the time t3, the input data signal IN at a High level (VE3) corresponding to the data output period TD2 is continuously supplied to the input terminal 1. At this point, the transistor M3 does not turn on because the transistor M2 is turned off.

At the time t3, the transistor M1 is turned off and the transistor M2 is turned on. The transistor M3 is also turned on, and the level of the node 2 is lowered from High (VE1) to Low (VE2) again.

At a time t4, the operation of the clocked inverter 10 is resumed. The time t4 is a (data output period switch) timing at which data of the output data signal OUT of the output terminal 3 and data of the output data signal OUTB of the output terminal 4 are switched. The data output signals having the same High (VE1) and Low (VE2) logical values as in the data output period TD1 are continuously output from the output terminals 3 and 4, respectively.

At a time t5, the control signal S3 is set to be Low (VE2) from High. The switch SW1 is turned on, and the output data signal OUT of the output terminal 3 and the output data signal OUTB of the output terminal 4 are stably held.

The following describes the operations at a time of switching from the data output period TD2 to the data output period TD3. Since operations using the control signals S1, S2, and S3 at times t1 to t3 are common for each data output period described above, descriptions of the operations using the control signals S1, S2, and S3 will be omitted.

The input data signal IN at a Low level (VE4) corresponding to the data output period TD3 is supplied to the input terminal 1 at a predetermined timing (time ti3) between the times t2 and t3.

At the time t3, the transistors M1 and M2 are respectively turned off and on. Since the low level (VE4) is applied to the gate of the transistor M3, the transistor M3 is in an off state.

At a time t4, the operation of the clocked inverter 10 is resumed. The time t4 is a (data output period switch) timing, at which data values of the output data signal OUT of the output terminal 3 and the output data signal OUTB of the output terminal 4 are switched. The output data signals having Low (VE2) and High (VE1) logical values are respectively output from the output terminals 3 and 4, according to the logical value of the node 2.

At a time t5, the control signal S3 is set to Low (VE2) from High to turn on the switch SW1. The output data signal OUT of the output terminal 3 and the output data signal OUTB of the output terminal 4 are stably held.

Next, the following describes the operations at a time of switching from the data period output TD3 to the data output period TD4. The operations using the control signals S1, S2, and S3 at times t1 to t3 are common for each data output period described above. Thus, descriptions of the operations using the control signals S1, S2, and S3 will be omitted.

At a predetermined timing (time ti4) between the times t2 and t3, the input data signal IN at a Low level (VE4) corresponding to the data output period TD4 is supplied to the input terminal 1.

The transistors M1 and M2 are respectively turned off and on at the time t3. However, the Low level (VE4) is applied to the gate of the transistor M3. Thus, the transistor M3 is off, and the level of the node 2 is held at High (VE1).

The operation of the clocked inverter 10 is resumed at a time t4, and the output data signals having Low (VE2) and High (VE1) logical values are respectively output from the output terminals 3 and 4 continuously with the data output period TD3.

At a time t5, the control signal S3 is set to be Low (VE2) from High to turn on the switch SW1. The output data signal OUT of the output terminal 3 and the output data signal OUTB of the output terminal 4 are stably held.

The data output periods TD0 to TD4 include all changes of the input data signal IN and the output data signal OUT. That is, the high-amplitude output data signal OUT having a same logical value as the corresponding input data signal IN is output without fail at the timing (time 4) of switching of each data output period for each of data transitions of a change of the low-amplitude input data signal IN from Low to High, continuation of the High level of the low-amplitude input data signal IN, a change of the low-amplitude input data signal IN from High to Low, and continuation of the Low level of the low-amplitude input data signal IN.

With respect to times at which logical values of the control signals S1, S2, and S3 are changed, each of time periods (time intervals) from t0 to t1, from t1 to t2, from t2 to t3, and from t4 to t5 can be set to be sufficiently short because operation of each of the transistor M1, the switch SW1, and the clocked inverter 10 is quickly controlled by the high-amplitude control signal. On the other hand, a time period (time interval) from t3 to t4 needs to be set to a time period in which a change of the level of the node 2 from High (VE1) to Low (VE2) is completed in view of current driving capability of the transistor M3. It is because a time period taken for the change of the level of the node 2 from High (VE1) to Low (VE2) depends on the current driving capability of the transistor M3 which receives the low-amplitude signal at the High (VE3) level at the gate thereof.

<Operating Speed>

The following describes an analysis of an operating speed of the level shift circuit according to the present exemplary embodiment shown in FIG. 1. As mentioned above, the transition time (fall time) of the level of the node 2 from High (VE1) to Low (VE2) depends on the current driving capability of the transistor M3. When one of the transistor M1 for charging the node 2 and the transistor M2 for controlling discharging of the node 2 is turned on, the other of the transistor M1 and the transistor M2 is turned off. Thus, no through current flows at a current path between the power supplies E1 and E2 via the node 2. Accordingly, the level of the node 2 is able to be comparatively quickly changed from High (VE1) to Low (VE2), without being disturbed by the through current.

Since the inverting operation of the clocked inverter 10 is started at the time t4 at which the voltage change of the node 2 has been completed, the logical value of the output data signal OUT is changed to be the one opposite to the logical value of the node 2 at high speed after the start of the time 4. Similarly, a logical value of the output data signal OUTB of the output terminal 4 is also changed to the one which is same as the node 2 at high speed, following the change of the output data signal OUT.

The load capacitances Cp3 and Cp4 are connected to the output terminals 3 and 4, respectively. The output terminal 3 is driven by the clocked inverter 10 which operates upon reception of a high-amplitude voltage signal at the node 2. The output terminal 4 is driven by the inverter 20 which operates upon reception of a high-amplitude voltage signal at the output terminal 3. For this reason, each of the load capacitances Cp3 and Cp4 is driven at high speed by the high-amplitude voltage signal. That is, the level shift circuit in FIG. 1 is suited to a high-speed operation.

The following describes an analysis of current consumption of the level shift circuit in FIG. 1. As mentioned above, no through current occurs in the current path (current path for the transistors M1, M2, and M3) between the power supplies E1 and E2 via the node 2. Since voltage changes of the node 2 and the output terminal 3 are quick, very little through current flows through each of the clocked inverter 10 and the inverter 20. Accordingly, the current consumption of the level shift circuit in FIG. 1 can be sufficiently limited to be small.

<Output Stability>

The following describes an analysis of output stability of the level shift circuit according to the present exemplary embodiment shown in FIG. 1. The control signal S3 is set to be Low (VE2), the switch SW1 is turned on, and an output (output terminal 4) of the inverter 20 is feedback connected to an input (node 2) of the clocked inverter 10 from the time t5 after switching of the data output period to the time t0 before switching to the subsequent data output period. Accordingly, the output data signal OUT of the output terminal 3 and the output data signal OUTB of the output terminal 4 are stably held.

On the other hand, when outputting the output data signal OUT at the Low level (VE2) in a subsequent data output period, as at the time of switching from the data output period TD2 to the data output period TD3, or, at the time of switching from the data output period TD3 to the data output period TD4, the High level (VE1) of the node 2 precharged by the transistor M1 is held by parasitic capacitances of transistors connected to the node 2 (such as gate capacitances of the transistors of the clocked inverter which have gates connected in common to the node 2) during the time period from t2 to t3. However, since the time period from t2 to t3 is sufficiently short, it is not likely that the node 2 undergoes a voltage variation due to influence of noise or the like.

A voltage at the output terminal 3 is held by the load capacitance Cp3 in a time period from t0 to t4 during which the clocked inverter 10 is stopped. In case the level shift circuit in FIG. 1 drives a decoder of a display data driver, the load capacitance Cp3 can sufficiently stably hold the voltage at the output terminal 3, because the load capacitance Cp3 corresponds to the load capacitance of the bit line of the decoder.

As described above, at the time of switching of the data output period, there is a time period in the data output period in which a voltage at a node (for example, node 2) in the level shift circuit is temporarily held by a parasitic capacitance. This time period is sufficiently short with respect to one data output period, and it is not likely that a voltage variation due to influence of noise or the like occurs in the node. During most of the one data output period, the High or Low voltage level of the node 2 is stably held after having been settled, because the output of the inverter 20 (output terminal 4) is feedback connected to the input of the clocked inverter 10 (node 2).

The following describes a timing at which the input data signal IN is supplied to the input terminal 1. Preferably, the timing at which the input data signal IN is supplied to the input terminal 1 is within the time period from t2 to t3, as shown in FIG. 2. However, it is possible to set the input timing of the input data signal IN to be within a time period from t3 to t4, as necessary. In that case, the input timing of the input data signal IN is set such that a change of the logical value of the node 2 is completed before the time t4. When the input timing of the input data signal IN is before the timing t2, there may be a case wherein a through current between the power supplies E1 and E2 may happen to flow. Assume that the input timing of the input data signal IN is between the times t4 and t5. Then, the switch timing of the data output period, at which the data output signal OUT is changed from High to Low, is controlled to be the time t4 by the control signal S2. The switch timing of the data output period, at which the data output signal OUT is changed from Low to High, corresponds to the input timing at which the input data signal IN is supplied to the input terminal 1. Thus, when the input timing of the input data signal IN is between the times t4 and t5, unified control of switching of the data output periods for both transitions Low to High, and High to Low of the data output signal becomes difficult.

Second Exemplary Embodiment

Figure 3:
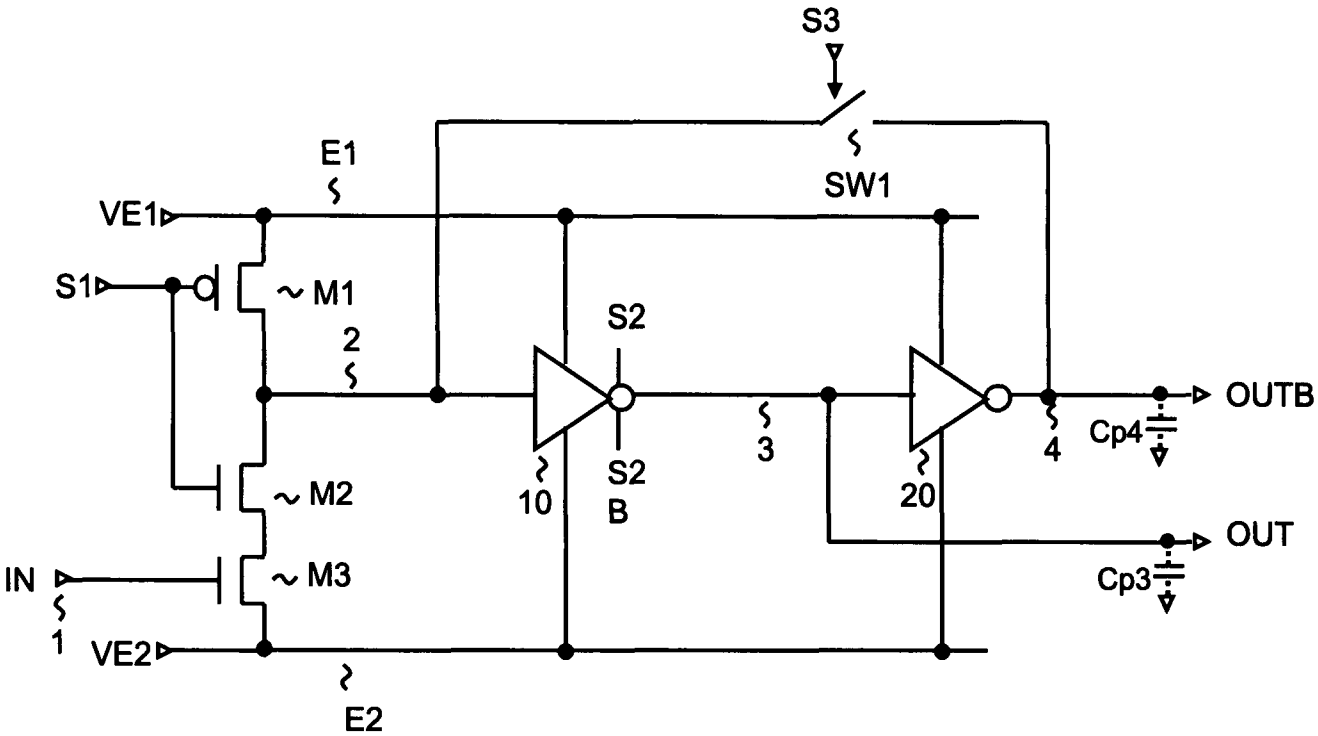
FIG. 3 is a diagram showing a configuration of a second exemplary embodiment of the present invention.

FIG. 3 is a diagram showing a configuration of a second exemplary embodiment of the present invention. Referring to FIG. 2, in a level shift circuit according to this exemplary embodiment, connection positions of the N-channel MOS transistors M2 and M3 in FIG. 1 are interchanged. The other configurations are the same as those in FIG. 1. Control signals S1, S2, S2B, and S3 which are the same as those described with reference to FIGS. 1 and 2 are employed. The control signal generation circuit 90 in FIG. 1 is not illustrated in FIG. 3.

A timing chart of an input data signal IN, output data signals OUT and OUTB, a voltage at a node 2, and the control signals S1, S2, and S3 in the level shift circuit in FIG. 3 is the same as FIG. 2. Even if the connection order of the transistors M2 and M3 is changed, the node 2 and the power supply line E2 are not electrically conducted unless both of the input data signal IN and the control signal S1 go High. Thus, voltage waveforms of the node 2 and the output terminals 3 and 4 become the same as those in FIG. 2. Accordingly, the level shift circuit in FIG. 3 has the same performance as the level shift circuit in FIG. 1.

First Example

Figure 4:
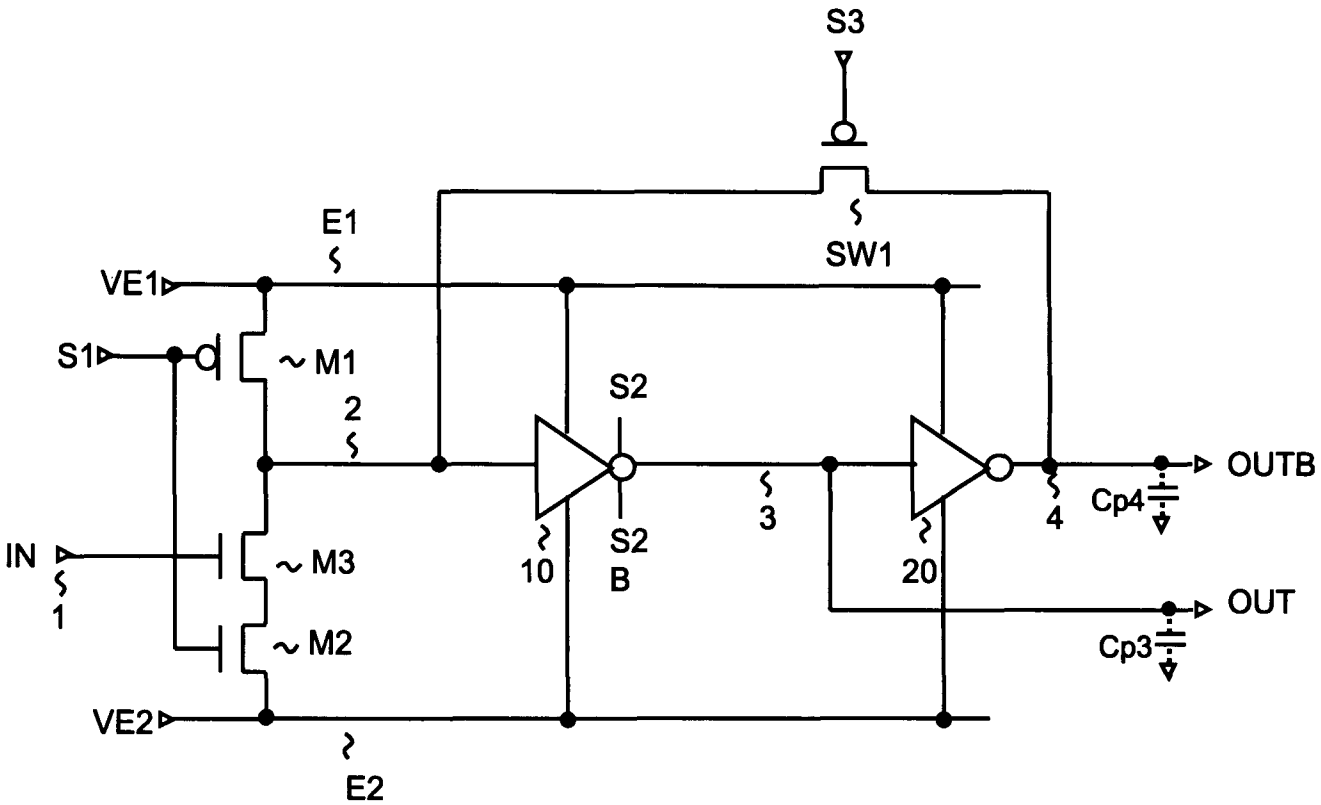
FIG. 4 is a diagram showing a configuration of a first example of the present invention.

FIG. 4 is a diagram showing a configuration of an example which constitutes a specific example of the first exemplary embodiment in FIG. 1. Referring to FIG. 4, the switch SW1 in FIG. 1 comprises a P-channel MOS transistor connected between a node 2 and an output terminal 4. A control signal S3 is supplied to a gate of the P-channel MOS transistor. In case the feedback control switch (SW1) comprises a P-channel MOS transistor switch alone and the output terminal 4 is Low (VE2), the voltage at the Low level (VE2) cannot be transmitted to a node 2, when the voltage at the Low level (VE2) does not exceed a threshold voltage |Vtp| (absolute value). However, in the present exemplary embodiment, when the node 2 is Low (VE2), an input data signal IN is set to be High (VE3), a control signal S1 is also set to be High (VE1), and the node 2 and a power supply line E2 are electrically conducted via N-channel MOS transistors M2 and M3. Accordingly, even if the feedback control switch (SW1) is formed of the P-channel MOS transistor switch, the low level (VE2) of the node 2 is stably held. Further, a CMOS switch (formed of N-channel and P-channel MOS transistors) configuration is not adopted as the feedback control switch (SW1). The number of transistors is thereby reduced to contribute to area saving. Similarly, the switch SW1 in FIG. 3 may be formed of the P-channel MOS transistor switch alone.

Figure 5A:
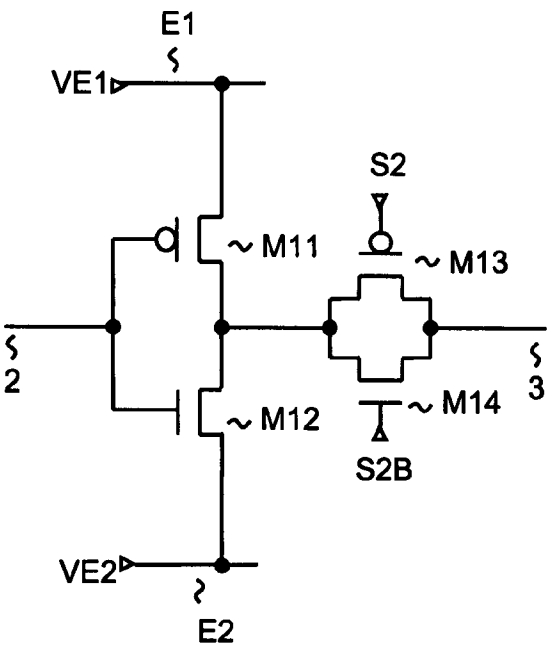
FIG. 5 includes diagrams each showing a configuration of a clocked inverter.
Figure 5B:
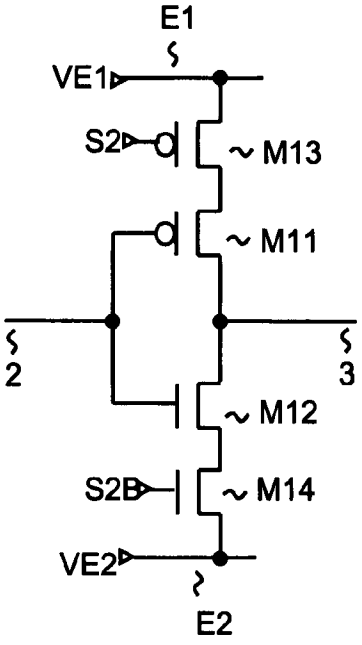
Figure 5C:
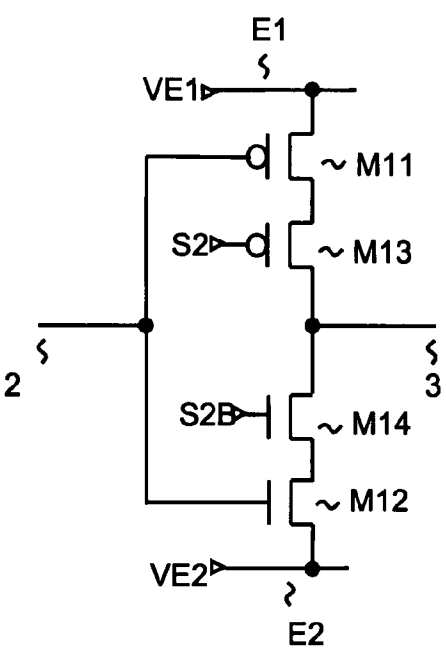

FIGS. 5A, 5B, and 5C are diagrams respectively showing configuration examples of the clocked inverters 10 in FIGS. 1, 3, and 4.

In the clocked inverter 10 in FIG. 5A, a CMOS inverter (M11, M12) and a CMOS switch (formed of a P-channel MOS transistor M13 and an N-channel MOS transistor M14) are connected in series between a node 2 and an output terminal 3. A control signal S2 is supplied to a gate of the P-channel MOS transistor M13, and a complementary signal S2B of the control signal S2 is supplied to a gate of the N-channel MOS transistor M14. A High or Low level of the control signal S2 corresponds to the high or low level of the control signal in the timing chart of FIG. 2. When a voltage change of the node 2 which depends on current driving capability of a transistor M3 is slow (fall of the voltage of the node 2 is slow) in the clocked inverter 10 in FIG. 5A, a voltage change of the inverter (M11, M12) is also slow. Then, a through current transiently flows through the inverter (M11, M12). For this reason, the level shift circuit can be used when the voltage change of the node 2 is sufficiently fast.

In the clocked inverter 10 in FIG. 5B, drains of a P-channel MOS transistor M11 and an N-channel MOS transistor M12 which constitute a CMOS inverter are connected in common to an output terminal 3. Respective gates of the P-channel MOS transistor M11 and the N-channel MOS transistor M12 are connected in common to a node 2. Sources of a P-channel MOS transistor M13 and an N-channel MOS transistor M14 which constitute a CMOS switch are connected to power supply lines E1 and E2, respectively. Drains of the P-channel MOS transistor M13 and the N-channel MOS transistor M14 are connected to sources of the transistors M11 and M12, respectively. A control signal S2 is supplied to a gate of the P-channel MOS transistor M13, and a complementary signal S2B of the control signal S2 is supplied to a gate of the N-channel MOS transistor M14. A High or Low level of the control signal S2 corresponds to the High or Low level of the control signal S2 in the timing chart of FIG. 2.

Even if a voltage change of the node 2 which depends on current driving capability of a transistor M3 is slow in the clocked inverter 10 in FIG. 5B, the transistors M13 and M14 are turned off by the control signal S2 until the voltage change is completed. A through current which depends on a voltage change speed of the node 2 can be thereby prevented. On the other hand, in the clocked inverter 10 in FIG. 5B, a through current may occur due to parasitic capacitances of the transistors of the CMOS inverter. Specifically, when an output data signal OUT switches from High (VE1) to Low (VE2) (at a time of data output period switching from a data output period TD2 to a data output period TD3 in FIG. 2), a High level (VE1) of the node 2 is held by the parasitic capacitances during a time period from t3 to t5. At a time t4, the control signal S2 goes Low (accordingly, a control signal S2B goes High), the transistors M13 and M14 are turned on. Then, when the output data signal OUT quickly changes from High (VE1) to Low (VE2), a potential at the node 2 may be slightly reduced due to capacitive coupling of parasitic capacitances Cgd between the drains and gates of the transistors M11 and M12 which constitute the CMOS inverter. Since the node 2 is held by the parasitic capacitances, the node 2 cannot be returned to an original potential (VE1). The through current may therefore occur.

However, a time period from t4 to t5 is set to a sufficiently short time. A period of time during which the through current occurs is sufficiently short. Further, by setting the size of the CMOS inverter (M11, M12) to be small so as to reduce the parasitic capacitances of the transistors M11 and M12, the through current can be prevented.

In the clocked inverter 10 in FIG. 5C, sources of a P-channel MOS transistor M11 and an N-channel MOS transistor M12 which constitute a CMOS inverter are connected to power supply lines E1 and E2, respectively. Gates of the P-channel MOS transistor M11 and the N-channel MOS transistor M12 are connected in common to a node 2. Sources of a P-channel MOS transistor M13 and an N-channel MOS transistor M14 which constitute a CMOS switch are connected to drains of the transistors M11 and M12, respectively. Drains of the P-channel MOS transistor M13 and the N-channel MOS transistor M14 are connected in common to an output terminal 3. A control signal S2 is supplied to a gate of the P-channel MOS transistor M13, and a complementary signal S2B of the control signal S2 is supplied to a gate of the N-channel MOS transistor M14. A High or Low level of the control signal S2 corresponds to the High or Low level of the control signal S2 in the timing chart in FIG. 2.

Even if a voltage change of the node 2 which depends on current driving capability of a transistor M3 is slow in the clocked inverter 10 in FIG. 5C, the transistors M13 and M14 are turned off by the control signal S2 until the voltage change is completed. A through current which depends on a voltage change speed of the node 2 can be prevented. Further, parasitic capacitances Cgd between the gates and the drains of the inverter (M11, M12) are separated from the output terminal 3 due to the transistors M13 and M14. Thus, even if an output data signal OUT at the output terminal 3 is quickly changed, the node 2 is scarcely affected by capacitive coupling.

As described above, for the clocked inverter 10 in each of FIGS. 1, 3, and 4, the configuration in FIG. 5C is the most preferred. However, depending on a condition, the configuration in FIG. 5A or 5B may be applied.

Second Example

Figure 6:
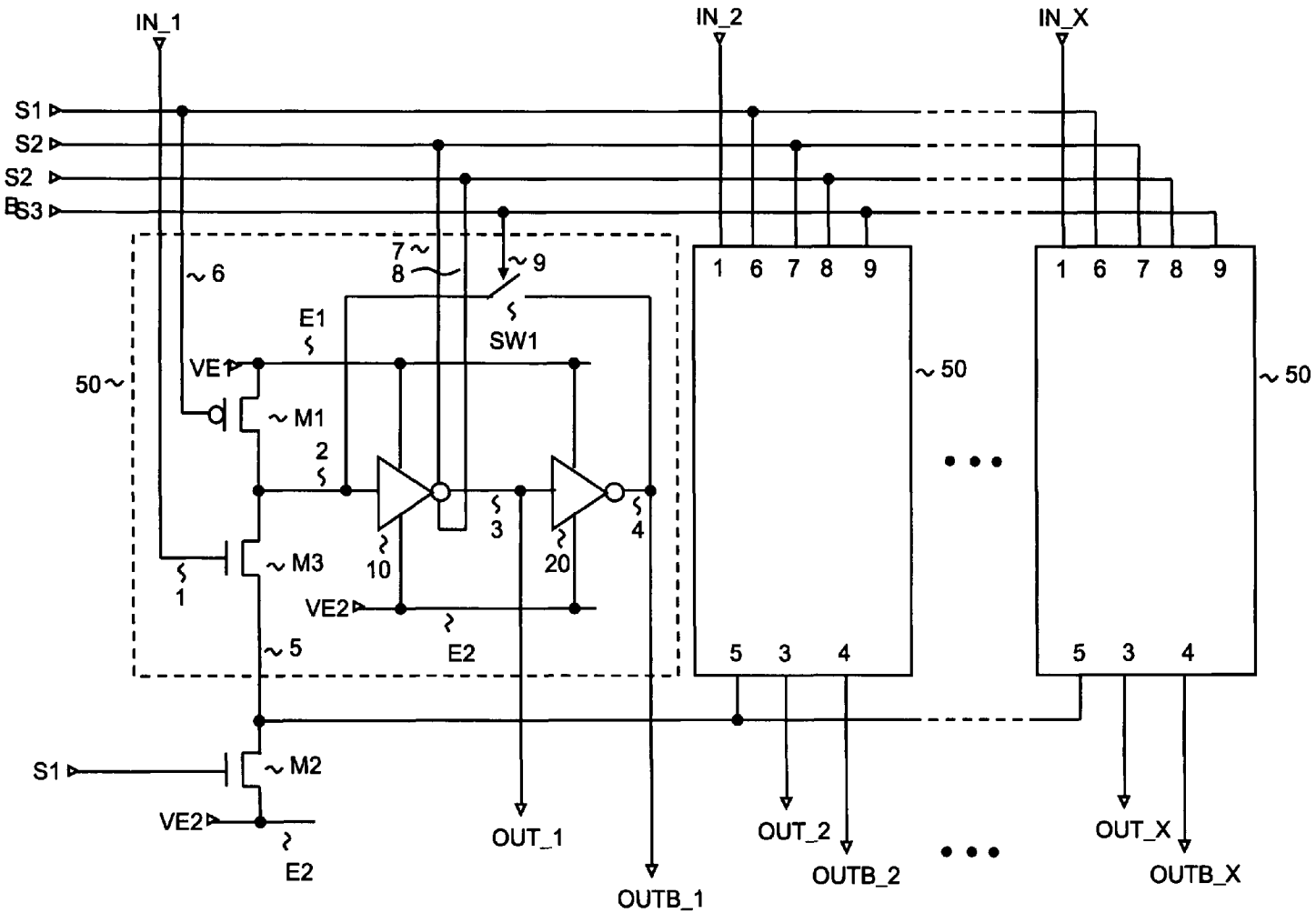
FIG. 6 is a diagram showing a configuration of a second example of the present invention.

FIG. 6 is a diagram showing a configuration of an example which constitutes a specific example of the exemplary embodiment in FIG. 1. This example has a configuration in which one N-channel MOS transistor M2 is shared by a plurality (X) of the set of level shift circuits in FIG. 1. Referring to FIG. 6, the level shift circuit excluding the N-channel MOS transistor M2 in FIG. 1 is designated as a circuit 50.

Control signals S1, S2, S2B, and S3 may be made common to the plurality (X) of the circuits 50. Each of input signals (IN_1 to IN_X) and output signals (OUT_1 to OUT_X) and complementary output signals (OUTB_1 to OUTB_X) is individually provided for each circuit 50. The control signals S1, S2, S2B, and S3 in FIG. 6 and each of the input data signals IN_1 to IN_X, and each of the output data signals OUT_1, OUTB_1 to OUT_X, and OUTB_X are set to have timing waveforms of the control signals S1, S2, S2B, S3, and the signals IN, OUT, and OUT_B shown in FIG. 2. With the configuration in FIG. 6, the number of transistors is reduced. Area saving thereby becomes possible.

Even if the input digital data signal has a significantly low amplitude, the level shift circuit in each of FIGS. 1, 3, 4 and 6 can quickly level-shift the input digital data signal to a high-amplitude data signal. The level shift circuit is formed of a small number of transistors, and a through current is sufficiently small.

Third Example

Figure 7:
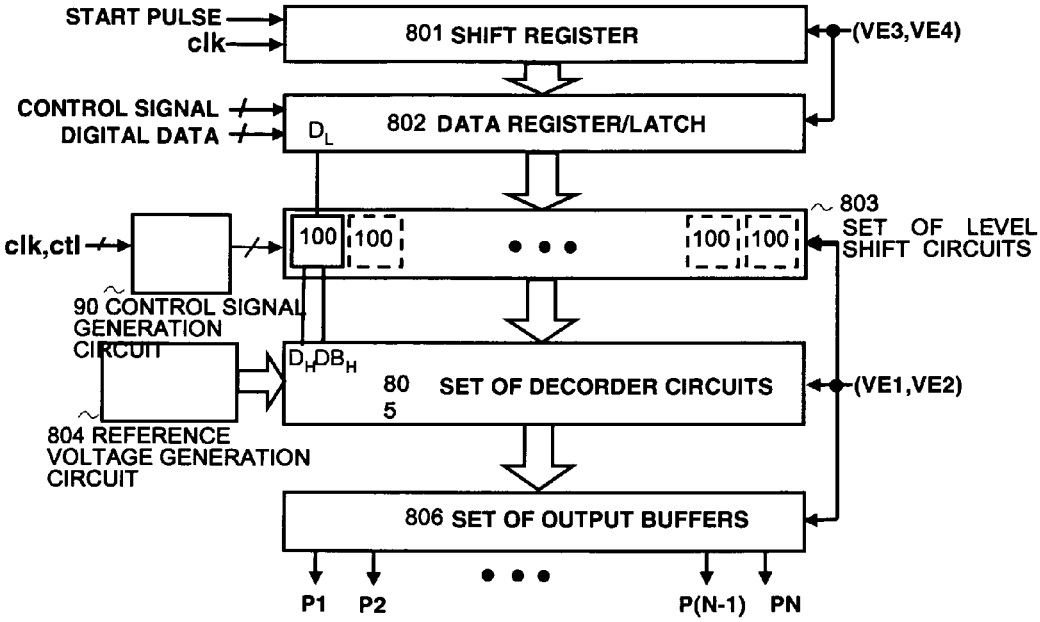
FIG. 7 is a diagram showing a configuration of a third example of the present invention.
Figure 8:
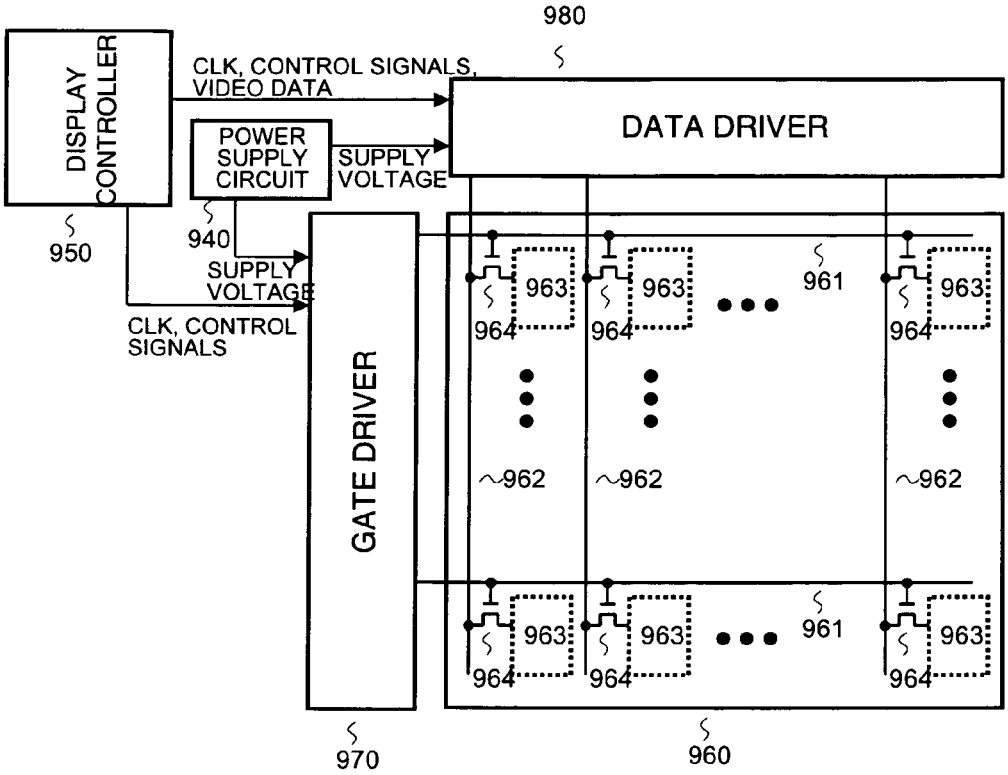
FIG. 8 is a diagram showing a configuration example of a display device.
Figure 9:
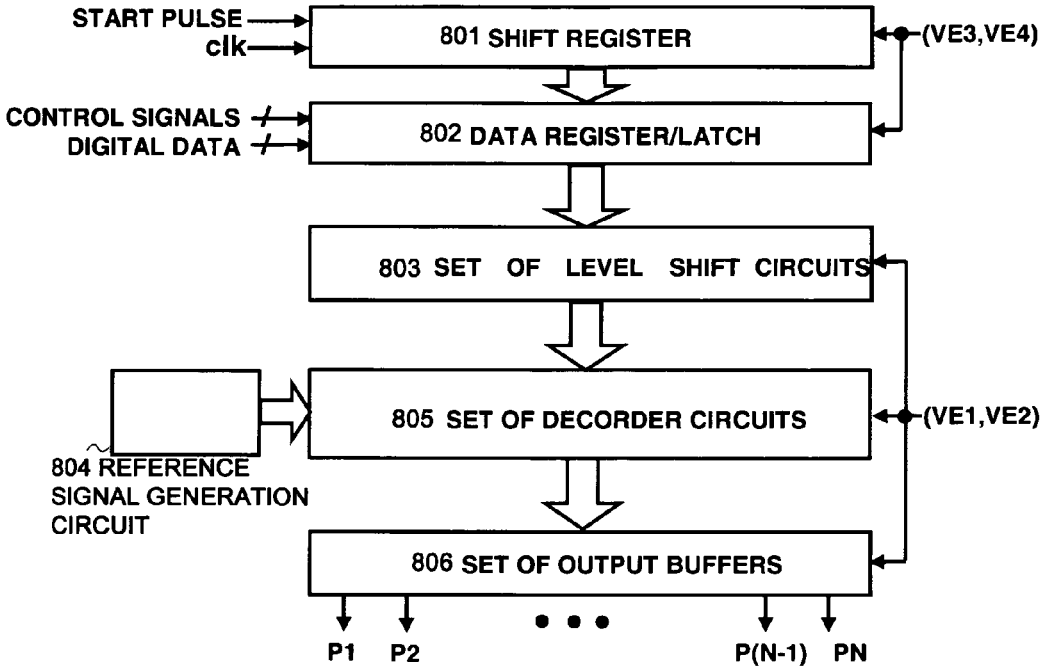
FIG. 9 is a diagram showing a configuration example of a data driver.

FIG. 7 shows a data driver according to a third example of the present invention. The data driver in FIG. 7 includes a plurality of level shift circuits 100 in this example described with reference to FIGS. 1 to 5 as the set of level shift circuits 803 of the data driver in FIG. 9. The data driver also includes the control signal generation circuit 90 in FIG. 1. The other blocks and the other functions are the same as those in FIG. 9.

The configuration in the second example in FIG. 6 may be applied as the set of level shift circuits 803 in FIG. 7.

Figure 10:
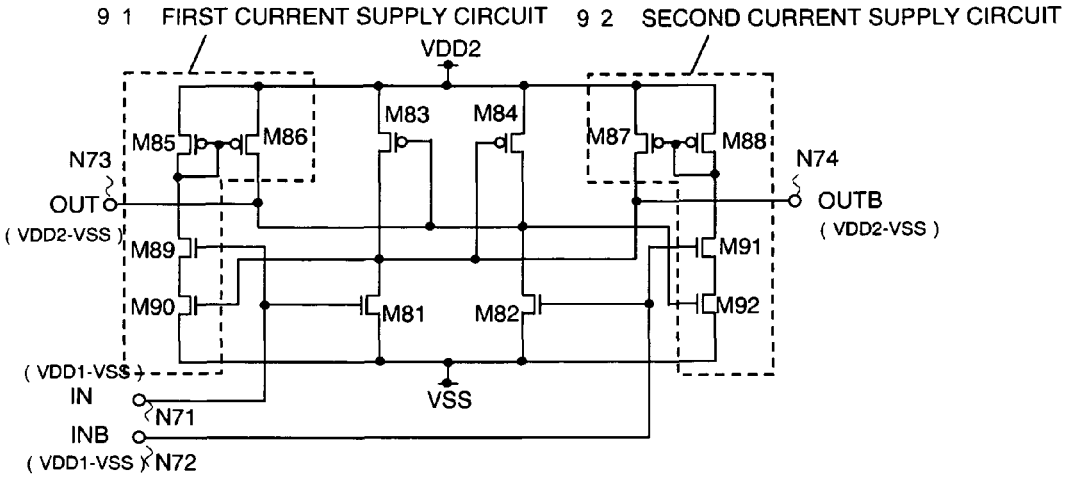
FIG. 10 PRIOR ART
FIG. 10 is a diagram showing a level shift circuit of a related art (Patent Document 1)
Figure 11:
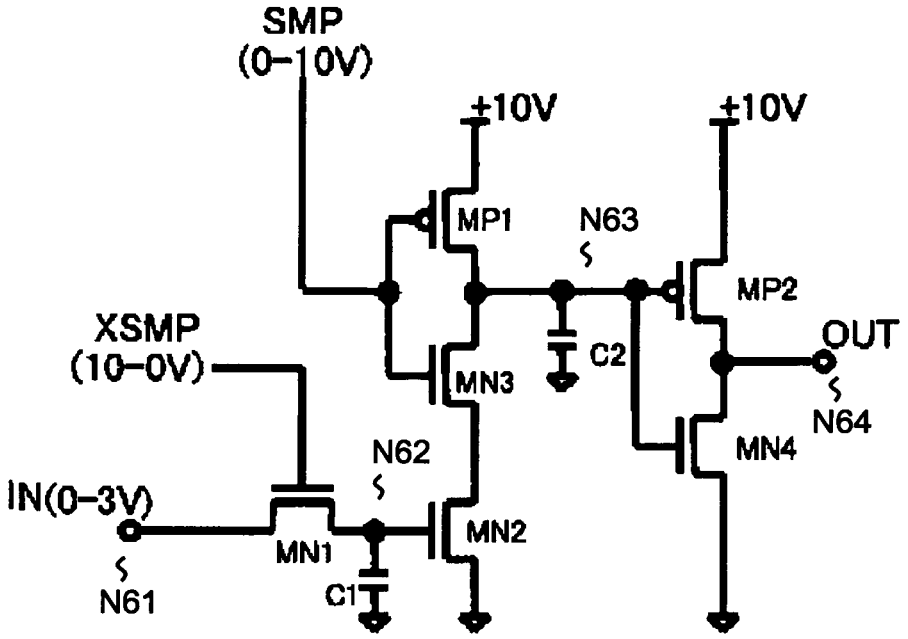
FIG. 11 PRIOR ART
FIG. 11 is a diagram showing a level shift circuit of a related art (Patent Document 2)

The control signal generation circuit 90 may be formed of a logic circuit (not shown) that generates low-amplitude control signals based on a low-amplitude clock clk and a low-amplitude timing signal ctl, and a plurality of level shift circuits (not shown) that perform level shifting of the low-amplitude control signals output by the logic circuit to high-amplitude control signals (S1, S2, S2B, S3), respectively. The level shift circuits (not shown) provided within the control signal generation circuit 90 each may include a level shift circuit which operates to perform level shifting at high speed in response to an input signal without using a control signal. The number of transistors may be increased in some degree. The level shift circuit in FIG. 10 or the like, for example, may be employed as a level shift circuit provided within the control signal generation circuit 90. The control signal generation circuit 90 can be shared by all of the set of level shift circuits 803 or a plurality of the level shift circuits 803. Thus, even if the number of transistors included in the control signal generation circuit 90 is increased in some degree, the increase in the number of transistors does not affect the area of the data driver.

When only one transistor is increased in each of the set of level shift circuits 803, a plurality of transistors the number of which is the product between the number of outputs and the number of bits will be increased in the set of level shift circuits 803 as a whole. For this reason, even reduction of the number of transistors just one in each level shift is important for achieve area saving.

The level shift circuit in each of the exemplary embodiments or the examples (in FIGS. 1, 3, 4, and 6) is formed of a small number of transistors, and the data driver can be also formed with the area thereof saved.

Figure 12:
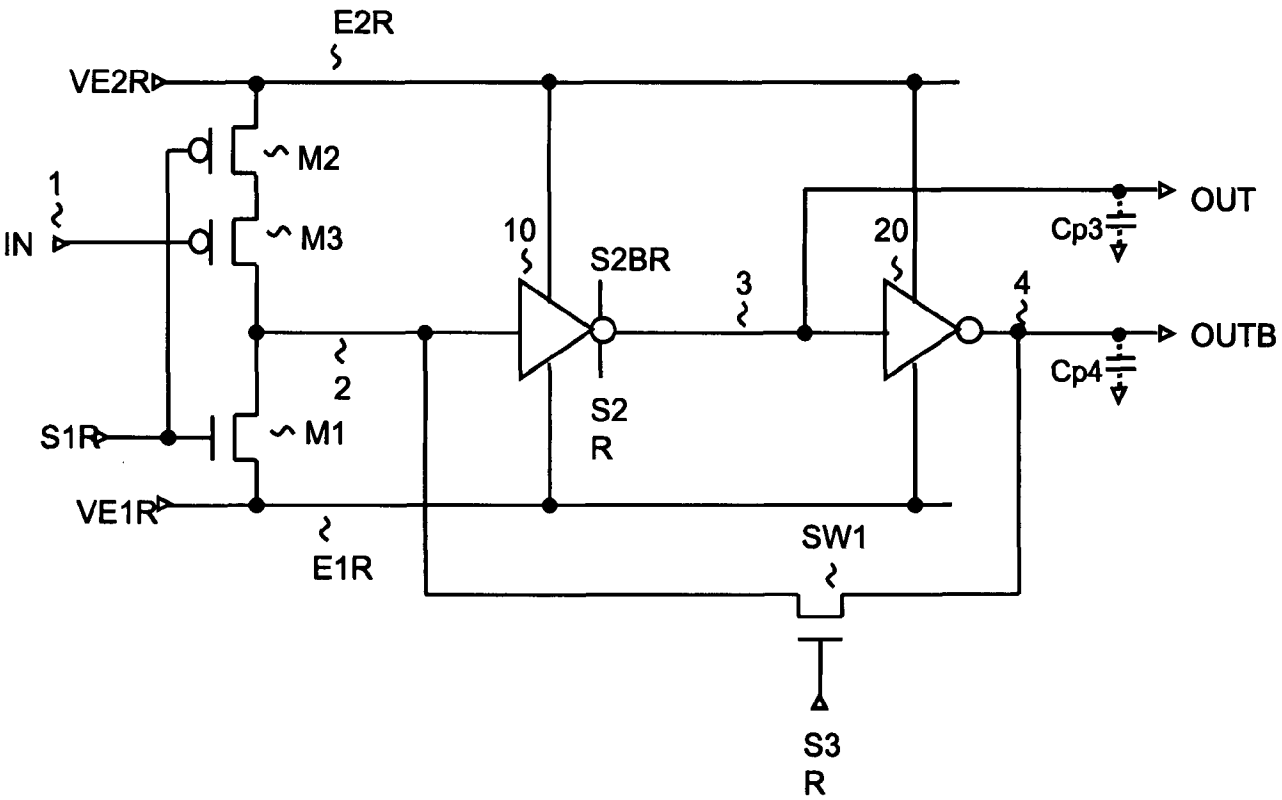
FIG. 12 is a diagram showing a configuration of a fourth example of the present invention.

Each of FIGS. 1 to 4 and FIG. 6 shows the example in which the High level (VE3) of the low-amplitude digital input data signal IN is level-shifted to the High level (VE1) of the high-amplitude (high-potential) output data signal OUT. Application to a configuration in which the Low level of the low-amplitude digital input data signal IN is level-shifted to the Low level of the high-amplitude (low-potential) output data signal OUT is readily possible. FIG. 12 is obtained by changing conductivity types of the MOS transistors M1, M2, and M3, and the switch SW1 in FIG. 4. When changing the conductivity types of the MOS transistors, Pch type is changed into Nch type, and the Nch type is changed to the Pch type. Further, the power supply lines E1 and E2 in FIG. 4 are respectively changed to power supply lines E1R and E2R, and the control signals S1, S2, S2B, and S3 are respectively changed to control signals S1R, S2BR, S2R, and S3R. With respect to the control signals to the clocked inverter 10, the control signals S2BR and S2R in FIG. 12 are respectively supplied to input ends of the control signals S2B and S2 in FIG. 4. Voltage levels of the data signal IN are set to VE3R and VE4R, and the power supplies E1R and E2R respectively supply voltage levels VE1R and VE2R. A magnitude relationship among the voltage levels is set to VE2R≥VE4R>VE3R>VE1R, which is set to be opposite in potential to a magnitude relationship of E1>E3>E4≥E2.

Figure 13:
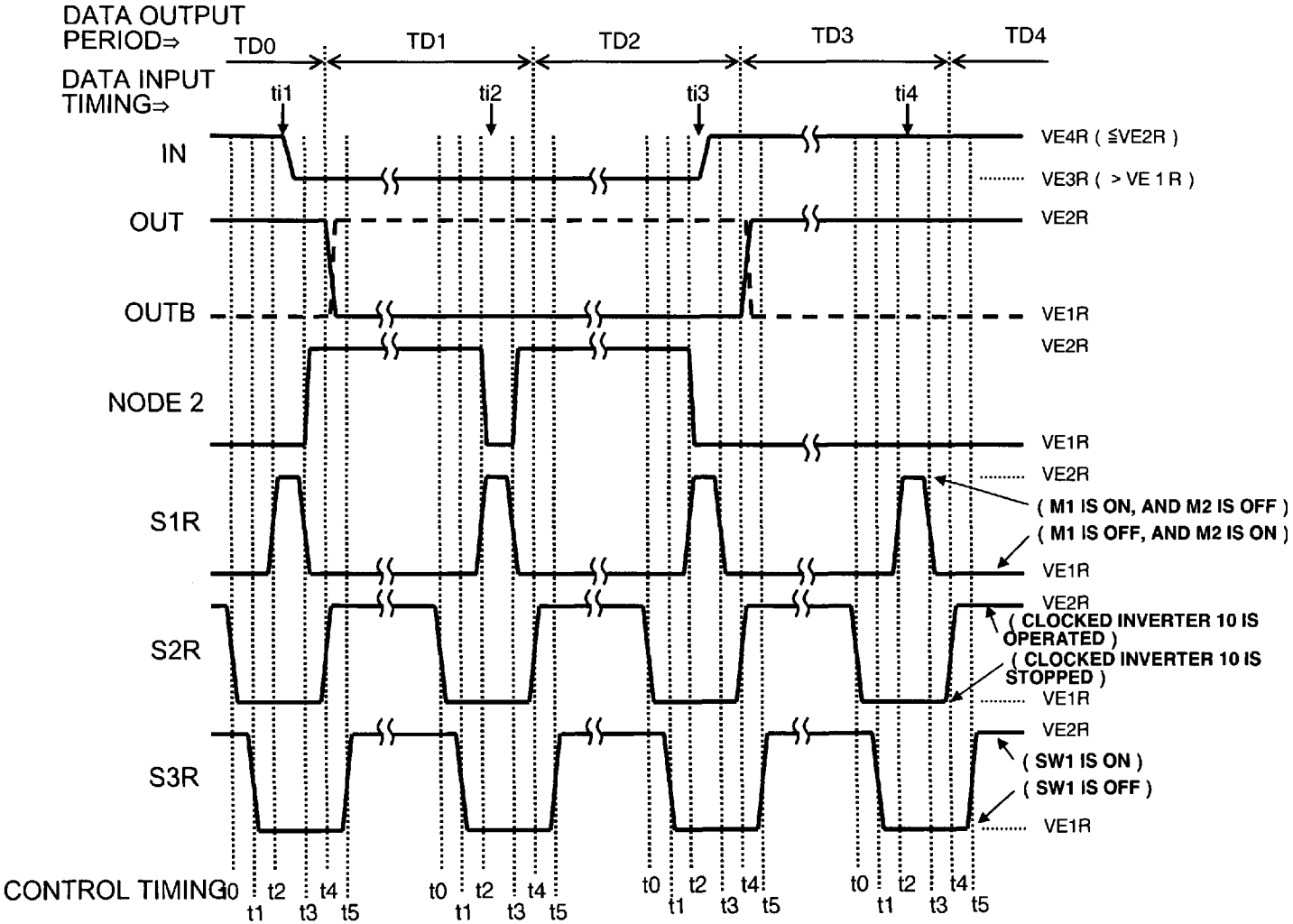
FIG. 13 is a timing chart showing an operation example of a level shift circuit in FIG. 12.

FIG. 13 is a timing chart showing an operation example of the level shift circuit in FIG. 12. FIG. 13 shows timing waveforms of an input data signal IN, output data signals OUT and OUTB, a voltage at a node 2, and the control signals S1R, S2R, and S3R in FIG. 12 (in which a complementary signal S2BR of the control signal S2R is omitted). Referring to FIG. 13, the control signals S1R, S2R, and S3R are set to complementary signals (reverse phase signals) of the control signals S1, S2, and S3 in FIG. 2, and waveforms of the signals IN, OUT, OUTB, and the node 2 become complementary signals of the signals IN, OUT, OUTB, and the node 2 in FIG. 2. On/off timings of the transistors M1 and M2, and the switch SW1 and an operation or stop timing of the clocked inverter 10 are the same as those in FIG. 2.

In the level shift circuit in FIG. 12, a configuration for level shifting the Low level (VE3R) of the input data signal IN to the Low level (VE1R) of the high-amplitude (low-potential) output data signal OUT can be implemented, using timing control shown in FIG. 13.

Each disclosure of Patent Documents 1 and 2 described above is incorporated herein by reference. Modifications and adjustments of the exemplary embodiments and the examples are possible within the scope of the overall disclosure (including claims) of the present invention, and based on the basic technical concept of the invention. Various combinations and selections of various disclosed elements are possible within the scope of the claims of the present invention. That is, the present invention of course includes various variations and modifications that could be made by those skilled in the art according to the overall disclosure including the claims and the technical concept.

What is claimed is:

1. A level shift circuit comprising:

an input terminal;

a first output terminal;

a first node;

a first power supply line connected to a first power supply having a first power supply voltage;

a second power supply line connected to a second power supply having a second power supply voltage;

a first transistor of a first conductivity type connected between said first power supply line and said first node;

second and third transistors of a second conductivity type connected in series between said second power supply line and said first node, said first transistor and said second transistor including control terminals supplied with a first control signal in common, said first transistor and said second transistor controlled to be turned on or off complementarily by said first control signal, said third transistor including a control terminal connected to said input terminal to which an input data signal is supplied, an amplitude of said input data signal being lower than a power supply amplitude between said first power supply voltage and said second power supply voltage;

a clocked inverter arranged between said first power supply line and said second power supply line, said clocked inverter including an input and an output connected to said first node and said first output terminal, respectively, said clocked inverter controlled to be turned on or off by a second control signal supplied thereto;

an inverter arranged between said first power supply line and said second power supply line, said inverter including an input connected to said first output terminal;

a switch connected between said first node and an output of said inverter, said switch controlled to be turned on or off by a third control signal supplied thereto; and a control signal generation circuit that generates said first to third control signals and supplies said first to third control signals to one or more level shift circuits, said control signal generation circuit deactivating said clocked inverter by said second control signal at a first timing, turning off said switch by said third control signal at a subsequent second timing, turning on said first transistor by said first control signal at a subsequent third timing to set said first node to said first power supply voltage, turning off said first transistor by said first control signal at a subsequent fourth timing, activating said clocked inverter by said second control signal at a subsequent fifth timing to cause said clocked inverter to invert a signal at said first node and to output said inverted signal to said first output terminal, and turning on said switch by said third control signal at a subsequent sixth timing to cause an output of said inverter to be electrically conducted to said first node, said first to fourth timings being positioned temporally before a data output switch timing, said fifth timing corresponding to said data output switch timing, and said sixth timing being positioned temporally after said data output switch timing.

2. The level shift circuit according to claim 1, wherein said input data signal is supplied to said level shift circuit at a predetermined timing between said third timing and said fourth timing.

3. The level shift circuit according to claim 1, wherein said output of said inverter is connected to a second output terminal.

4. The level shift circuit according to claim 1, wherein said clocked inverter comprises fourth to seventh transistors connected in series between said first power supply line and said second power supply line, said fourth and fifth transistors being of said first conductivity type and said sixth and seventh transistors being of said second conductivity type, said fourth and seventh transistors including control terminals connected in common to said first node, said second control signal and a complementary signal of said second control signal being supplied to control terminals of said fifth and sixth transistors, respectively, a connection node of said fifth and sixth transistors being connected to said first output terminal.

5. The level shift circuit according to claim 1, wherein said clocked inverter comprises:

a CMOS inverter including a fourth transistor of said first conductivity type and a fifth transistor of said second conductivity type connected in series, said fourth and fifth transistors including control terminals connected in common to said first node, a connection node of said fourth and fifth transistors being connected to said first output terminal;

a sixth transistor of said first conductivity type connected between said fourth transistor of said CMOS inverter and said first power supply line, said sixth transistor including a control terminal supplied with said second control signal; and a seventh transistor of said first conductivity type connected between said fifth transistor of said CMOS inverter and said second power supply, said seventh transistor including a control terminal supplied with a complementary signal of said second control signal.

6. The level shift circuit according to claim 1, wherein said clocked inverter comprises:

a CMOS inverter and a CMOS switch connected between said first node and said first output terminal, said CMOS inverter arranged between said first power supply line and said second power supply line and said CMOS switch being controlled to be turned on or off by said second control signal and a complementary signal of said second control signal.

7. The level shift circuit according to claim 1, wherein said second transistor is connected to said second power supply line, and said third transistor is connected to said first node.

8. The level shift circuit according to claim 1, wherein said third transistor is connected to said second power supply line, and said second transistor is connected to said first node.

9. The level shift circuit unit according to claim 7, wherein said second transistor is provided in common for a plurality of level shift circuits.

10. A data driver, comprising:

a level shift circuit that receives a video signal as an input data signal, and level-shifts said data signal to output said level-shifted data signal, said level shift circuit comprising:

an input terminal;

a first output terminal;

a first node;

a first power supply line connected to a first power supply having a first power supply voltage;

a second power supply line connected to a second power supply having a second power supply voltage;

a first transistor of a first conductivity type connected between said first power supply line and said first node;

second and third transistors of a second conductivity type connected in series between said second power supply line and said first node, said first transistor and said second transistor including control terminals supplied with a first control signal in common, said first transistor and said second transistor controlled to be turned on or off complementarily by said first control signal, said third transistor including a control terminal connected to said input terminal to which an input data signal is supplied, an amplitude of said input data signal being lower than a power supply amplitude between said first power supply voltage and said second power supply voltage;

a clocked inverter arranged between said first power supply line and said second power supply line, said clocked inverter including an input and an output connected to said first node and said first output terminal, respectively, said clocked inverter controlled to be turned on or off by a second control signal supplied thereto;

an inverter arranged between said first power supply line and said second power supply line, said inverter including an input connected to said first output terminal; and a switch connected between said first node and an output of said inverter, said switch controlled to be turned on or off by a third control signal supplied thereto;

a decoder circuit that decodes said level-shifted data signal output from said level shift circuit, and selects and outputs one or more reference voltages in accordance with said data signal, from among a plurality of reference voltage; and an output buffer circuit which receives said one or more output voltages from said decoder circuit to drive a signal line to which a display element is connected; and a control signal generation circuit that generates said first to third control signals and supplies said first to third control signals to a plurality of said level shift circuits, said control signal generation circuit deactivating said clocked inverter by said second control signal at a first timing, turning off said switch by said third control signal at a subsequent second timing, turning on said first transistor by said first control signal at a subsequent third timing to set said first node to said first power supply voltage, turning off said first transistor by said first control signal at a subsequent fourth timing, activating said clocked inverter by said second control signal at a subsequent fifth timing to cause said clocked inverter to invert a signal at said first node and to output said inverted signal to said first output terminal, and turning on said switch by said third control signal at a subsequent sixth timing to cause an output of said inverter to be electrically conducted to said first node, said first to fourth timings being all positioned temporally before a data output switch timing, said fifth timing corresponding to said data output switch timing, and said sixth timing being positioned temporally after said data output switch timing.

11. The data driver according to claim 10, comprising a plurality of said level shift circuits, said second transistor being provided in common, for a plurality of said level shift circuits.

12. The data driver according to claim 10, wherein said display element includes a liquid crystal or an organic light emitting diode.

13. A display device comprising said data driver as set forth claim 10.

* * * * *